US008302966B1

(12) United States Patent
Sullivan

(10) Patent No.: US 8,302,966 B1
(45) Date of Patent: Nov. 6, 2012

(54) PRIZE DISPENSING AMUSEMENT GAME

(76) Inventor: Royce Sullivan, Stanton, CA (US)

( * ) Notice: Subject to any disclaimer, the term of this patent is extended or adjusted under 35 U.S.C. 154(b) by 128 days.

(21) Appl. No.: 13/029,082

(22) Filed: Feb. 16, 2011

(51) Int. Cl.
*A63F 9/00* (2006.01)
*A63F 9/26* (2006.01)

(52) U.S. Cl. ..... 273/138.1; 273/138.2; 273/440; 273/450

(58) Field of Classification Search ..... 273/138.1, 273/138.2, 440, 450
See application file for complete search history.

(56) References Cited

U.S. PATENT DOCUMENTS

| | | | | |
|---|---|---|---|---|
| 3,764,143 | A | 10/1973 | Takahashi | |
| 3,787,050 | A | 1/1974 | Goldfarb | |
| 4,240,536 | A | 12/1980 | Noell, Jr. | |
| 4,487,414 | A | 12/1984 | Karkkainen et al. | |
| 4,640,509 | A | 2/1987 | Manspeaker | |
| 5,326,108 | A | 7/1994 | Faith | |
| 5,501,466 | A | 3/1996 | Welch et al. | |
| 5,713,572 | A | 2/1998 | Hagiwara | |
| 5,775,691 | A | 7/1998 | Hamano | |
| 6,062,567 | A | 5/2000 | Uetono et al. | |
| 6,206,370 | B1 | 3/2001 | Halliburton | |
| 6,634,940 | B2 * | 10/2003 | Yoshida et al. | 463/7 |
| 7,503,845 | B2 | 3/2009 | Ueshima et al. | |
| 7,507,152 | B2 | 3/2009 | Halliburton | |
| 7,600,760 | B2 | 10/2009 | Matsuda et al. | |
| 7,703,772 | B2 * | 4/2010 | Morikawa et al. | 273/440 |
| 7,731,587 | B2 | 6/2010 | Kumagai | |
| 7,845,645 | B1 | 12/2010 | Chu et al. | |
| 2003/0073479 | A1 * | 4/2003 | Wilson et al. | 463/16 |
| 2004/0036224 | A1 * | 2/2004 | Crompton | 273/454 |
| 2009/0224473 | A1 | 9/2009 | Motegi et al. | |
| 2010/0109248 | A1 | 5/2010 | Held et al. | |

* cited by examiner

*Primary Examiner* — Benjamin Layno
(74) *Attorney, Agent, or Firm* — QuickPatents, Inc.; Kevin Prince

(57) ABSTRACT

A game is disclosed that is played with coins to deliver a prize to a player. A coin delivery mechanism is adapted to deliver the coins proximate at least one coin platform via a sloped playing field having a plurality of apertures vertically aligned with each coin platform. A plurality of prize platforms each support a prize and are each mechanically coupled with one of the coin platforms to dispense the prize thereon when the weight of the plurality of coins retained by the coin platform reaches a critical weight. A prize chute is situated below each prize platform and delivers the prize to the player when the prize falls from the prize platform. A profit chute is situated below each coin platform and the playing field and is adapted to deliver the coins not retained by the coin platform into a coin storage receptacle.

24 Claims, 6 Drawing Sheets

PRIZE DISPENSING AMUSEMENT GAME

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to amusement games, and more particularly to a prize-dispensing amusement game.

DISCUSSION OF RELATED ART

Amusement games wherein the inserted coins play a role in the game have become increasingly popular, particularly with the advent of "coin pusher" type games such as that disclosed in U.S. Pat. No. 5,713,572 to Hagiwara on Feb. 3, 1998. Such games that display a large accumulation of coins can generate a high degree of excitement to those approaching the game, thereby enticing the player to play. Certain jurisdictions, however, do not allow monetary rewards to be delivered to the players. As a result, such games must be adapted to collect the coins that drop into the delivery chute of such games and convert the number of coins to some number of prize-redeemable coupons or the like. Much of the excitement of such games, as a result, is reduced, making these types of games less popular in such jurisdictions. Further, even in jurisdictions where such games are not outlawed, the payout odds of such games are difficult to adjust and maintain.

Games that deliver prize-redeemable coupons are not as attractive to many players as the games that deliver the prize itself. For example, so-called "claw machine" type games allow the user to position a mechanical claw above a prize in the hopes that the position of the claw is just right to successfully grab the prize when the claw is lowered. Any prize successfully grasped by the claw of such games is then dropped into a prize chute for delivery to the player immediately upon winning. As such, the winning player has played a part in selecting and winning the prize, and does not have to visit a prize redemption counter to perhaps stand in a line in order to claim a prize of previously unknown value. However, such claw machine type games do not generate the excitement of games that involve displaying an accumulation of the coins that are used to play the game.

Another game that delivers prizes immediately is disclosed in U.S. Pat. No. 7,600,760 to Matsuda et al. In such an amusement game, a plunger is positioned on an X,Y coordinate system by a user to coincide with a prize lever that can be tipped so as to urge the selected prize into a prize chute. If the X,Y position of the plunger is slightly misaligned with the lever, the lever is not tipped. Artificial hysteresis can be applied to the controls of the plunger in various degrees so as to make accurate placement of the plunger less likely, decreasing the odds of players winning the prizes displayed. Again, while such a machine does allow for the immediate winning of a selected and displayed prize, it does not display an accumulation of the coins that are used to play the game and thus lowers the excitement level associated with the game.

In addition to the "coin pusher" type games that display an accumulation of coins, other amusement games display the accumulation of coins in different ways. For example, U.S. Pat. No. 6,206,370 to Halliburton on Mar. 27, 2001, teaches a game with a revolving wheel having a plurality of target receptacles at a periphery thereof. A coin delivery mechanism delivers a coin inserted by a player down a ramp towards the revolving wheel. If the player has timed the insertion of the coin correctly, the coin will fall into the moving receptacle. Once enough coins have been captured by any of the receptacles, the center of gravity of the receptacle shifts to dump the coins into a prize chute for delivery to the player. The coins not captured by the receptacle are delivered down a profit chute into a profit receptacle out of sight from the player. This type of game, while tantalizing to the players who see the potential winnings in each receptacle, again is not legal in every jurisdiction. No provision is made in such a game to deliver a non-coin prize to the player immediately upon winning. Most of these types of games require electricity to run, limiting the number of suitable installation locations and increasing their operating costs.

Another amusement game that is exciting and tantalizing to players is disclosed in U.S. Pat. No. 7,845,645 to Chu et al on Dec. 7, 2010. Such a game provides a plurality of coin platforms that each retain a plurality of coins that have been flung onto the coin platform by a coin-throwing delivery mechanism. Once the weight of the accumulated coins reaches a tipping point, all of the coin platforms tilt so that all of the accumulated coins to be delivered to the user, or, as with the coin pusher type games in restricted jurisdictions, to deliver prize-redeemable coupons or the like. Such a device, while exciting to the player, again does not provide for the immediate delivery of a prize other than the coins that fall from the coin platforms. Further, once the coin platforms have tipped, the next player to approach the game will see that all of the platforms are empty, and will be less likely to play. Consequently, such a game must be "re-primed" with coins after each win or the machine will not be productive.

Therefore, there is a need for an amusement game that provides for the display of an accumulation of coins, the coins themselves playing a role in the action of the game. Such a needed device would allow the player, through a cursory visional inspection, to ascertain that if enough coins are collected on a coin platform, an associated prize platform will tip to deliver a prize on the prize platform. As such, the needed game would provide the excitement of the display of accumulated coins, the display of specific prizes, and the quick understanding on the part of the player of how to win any particular prize. Further, such a needed device would include a plurality of the prize platforms so that when one prize is won, other prizes will still be available and will not discourage subsequent players from playing the game, thereby requiring less attention from an attendant. Such a needed device could be made purely mechanically, requiring no electricity to run, and as such could be set-up virtually anywhere there is an audience and a hard surface to bolt the machine to in order to prevent tipping thereof by vandals. The present invention accomplishes these objectives.

SUMMARY OF THE INVENTION

The present device is a game that is played with coins to deliver a prize to a player. In its simplest embodiment, the game includes a coin platform adapted to receive and retain a plurality of the coins. A coin delivery mechanism is adapted to deliver the coins proximate the coin platform. A prize platform is adapted to support the prize and is mechanically coupled with the coin platform to dispense the prize when the weight of the plurality of coins retained by the coin platform reaches a critical weight. A prize chute is situated below the prize platform and is adapted to deliver the prize to the player when the prize falls from the prize platform. A profit chute is situated below the coin platform and is adapted to deliver the coins into a coin storage receptacle.

In one "teeter-totter" type embodiment, the coin platform and the prize platform are of substantially equal weight and on opposing sides of a pivoted lever. In such an embodiment, the critical weight that the plurality of accumulated coins on the coin platform must overcome is substantially the weight of the prize. Each prize platform in such an embodiment includes a deflector for deflecting the prize laterally into the prize chute when the lever tips. In an alternate embodiment of the invention, the longitudinal axes of the coin platform and prize platform are parallel but laterally offset such that when the lever tips, the prize slides towards the pivot and then off the prize platform and into the prize chute. The coins on the opposing side of the lever, that is, on the coin platform, slide off of the coin platform and into the profit chute.

In one embodiment, the game further includes a non-opaque playing field having at least one aperture therein. The playing field may include a raised end positioned vertically higher than a lowered end thereof, such that coins introduced to the raised end will slide down the playing field towards the lowered end, some of the coins perhaps dropping into the at least one aperture if horizontally aligned with the at least one aperture as the coin slides down the playing field.

The coin delivery mechanism is adapted to deliver the coins to the playing field, sequentially as the player inserts each coin. The coin delivery mechanism may include a trajectory adjustment such that the player may adjust the trajectory adjustment before inserting one of the coins therein so as to direct the coin into a desired area of the playing field. Further, a plurality of coin deflectors may be included for imparting pseudo-random horizontal position adjustments to the coin before the coin is delivered to the playing field.

In one embodiment, the game further includes a lever housing with a plurality of compartments for isolating a plurality of the prize platforms from a plurality of the coin platforms. In such an embodiment, a gap is defined between each coin platform and its associated compartment, such that coins falling into the compartment through one of the at least one apertures may either be retained on the coin platform or slip into the gap to fall into the profit chute.

In use, with a prize supported on each prize platform, the player uses the coin delivery mechanism to deliver coins to the playing field. Some of the coins may fall through the at least one aperture to collect on the coin platform of the at least one lever, while the other coins fall into the profit chute. When the weight of the coin platform and the accumulated coins thereon is sufficient to overcome the weight of the prize and the prize platform, the lever tips on the pivot so that the prize slides off of the prize platform into the prize chute for delivery to the player. The coins on the tipping coin platform fall into the profit chute.

A chassis is preferably further included for housing the coin delivery mechanism, the playing field, the lever housing and levers, prize chute, profit chute, and coin storage receptacle. The chassis is open to the player at the coin delivery mechanism and the prize chute. A lockable door is further included for accessing the coin storage receptacle and prize platforms, and further includes a window to allow the player to see the playing field and each lever therethrough without being able to contact or otherwise interact with the playing field.

The present invention is an amusement game that provides for the display of an accumulation of coins, the coins themselves playing a role in the action of the game. The present device allows the player, through a cursory visional inspection, to ascertain that if enough coins are collected on a coin platform, an associated prize platform will tip to deliver a prize on the prize platform. As such, the present game provides the excitement of the display of accumulated coins, the display of specific prizes, and the quick understanding on the part of the player of how to win any particular prize. Further, the present invention may include a plurality of the prize platforms so that when one prize is won, other prizes will still be available and will not inhibit subsequent players from playing the game. The present game can be made to operate purely mechanically, requiring no electricity to run, and as such can be set-up virtually anywhere there is an audience and a suitable mounting surface. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
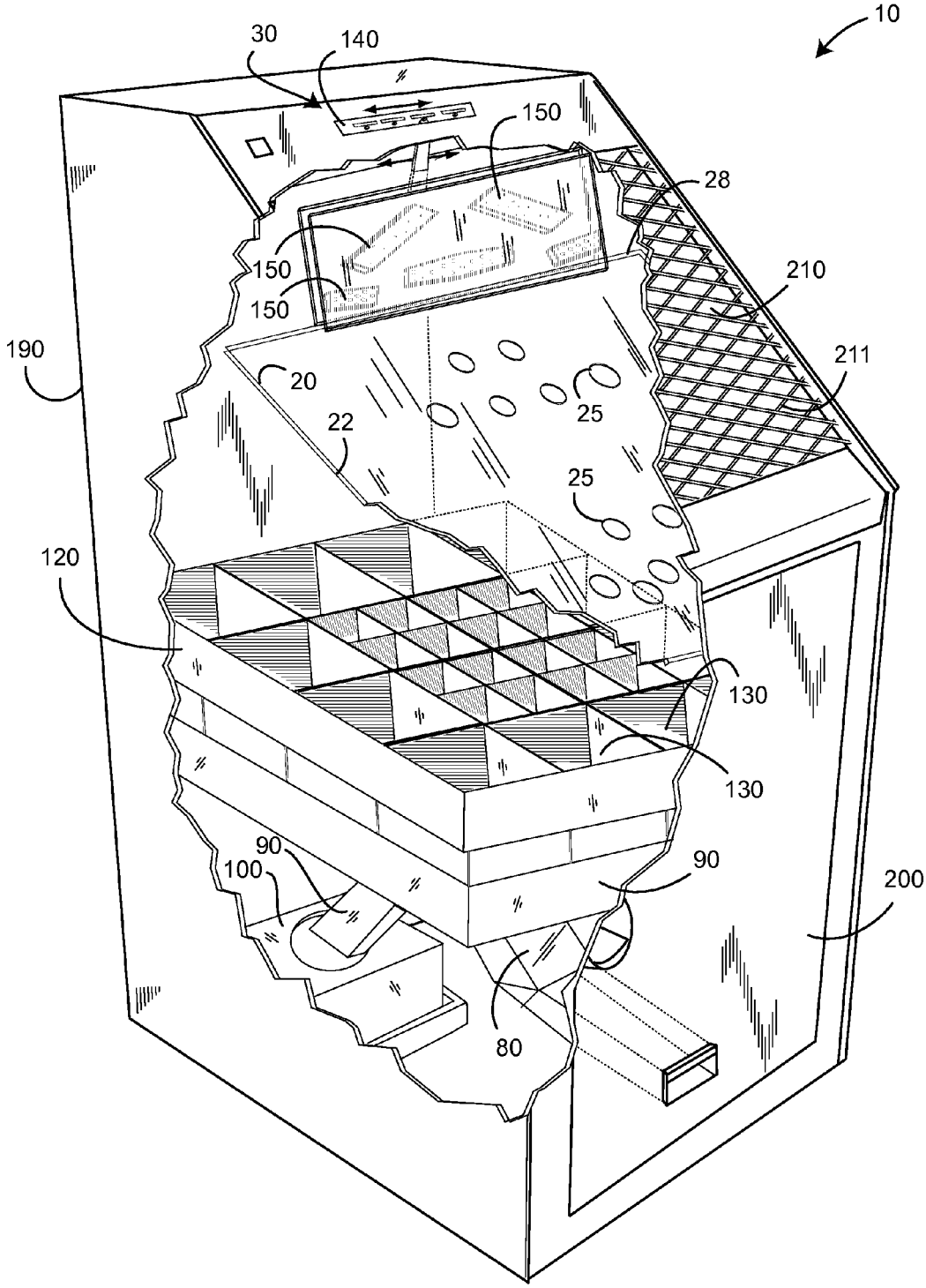
FIG. 1 is a perspective cut-away view of one embodiment of the invention.
Figure 2:
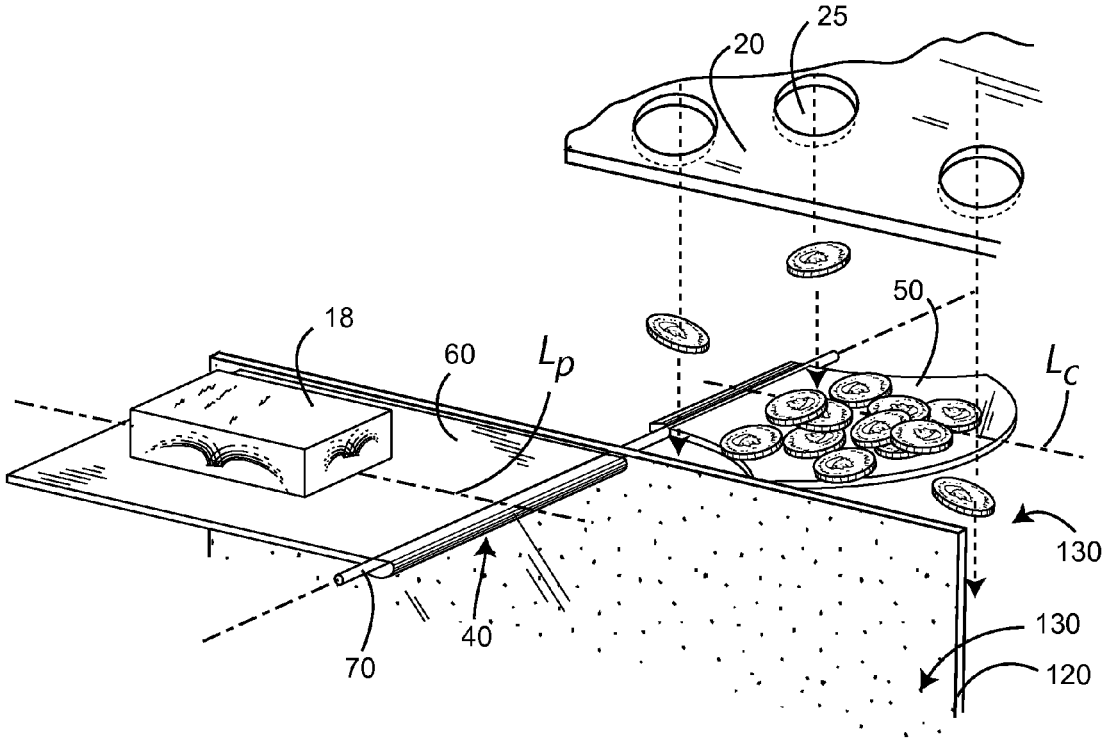
FIG. 2 is a perspective view of a playing field with apertures, a coin platform with coins, and a prize platform with a prize situated in a stable condition.

FIGS. 1 and 2 illustrate a game 10 that is played with coins 15 to deliver a prize 18 to a player (not shown). The game 10 includes a coin platform 50 adapted to receive and retain a plurality of coins 15. A coin delivery mechanism 30 is adapted to deliver the coins 15 proximate the coin platform 50. A prize platform 60 is adapted to support the prize 18 and is mechanically coupled with the coin platform 50 to dispense the prize 18 when the weight of the plurality of coins 15 retained by the coin platform 50 reaches a critical weight.

A prize chute 80 (FIGS. 1, 4) is situated below the prize platform 60 and is adapted to deliver the prize 18 to the player when the prize 18 falls from the prize platform 60. A profit chute 90 is situated below the coin platform 50 and is adapted to deliver the coins 15 into a coin storage receptacle 100.

Figure 6:
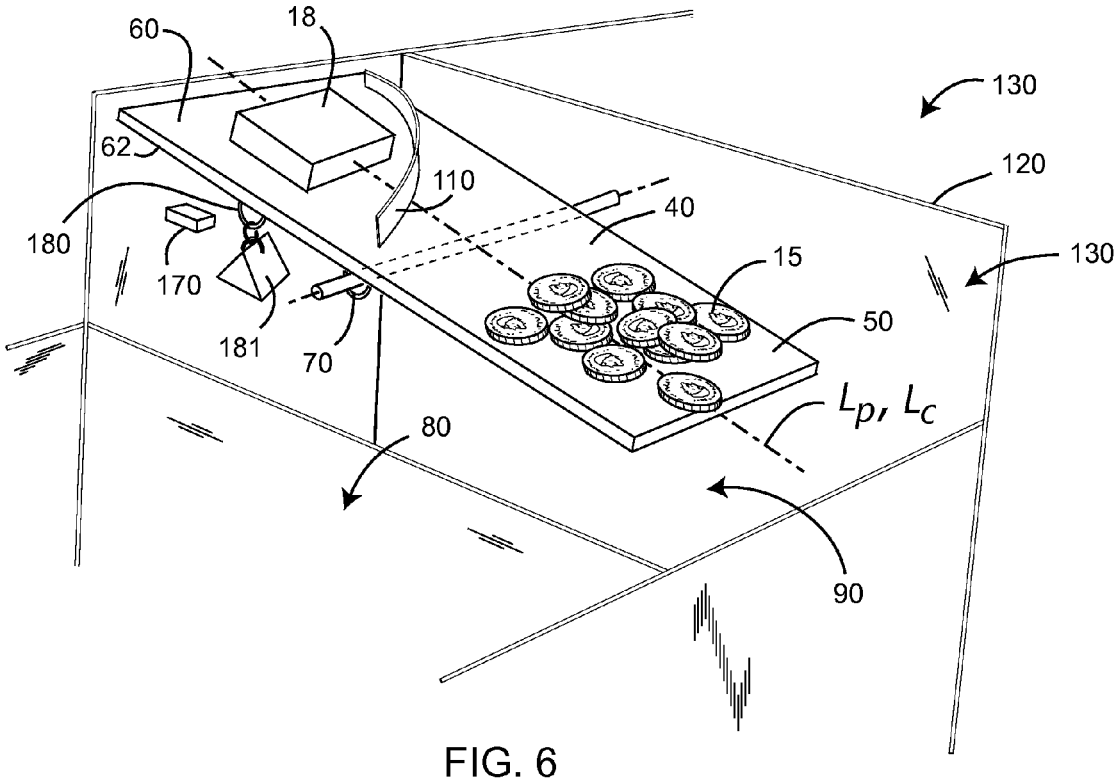
FIG. 6 is a perspective view of an alternate embodiment of a coin and prize platform lever of the invention.

In one embodiment, the coin platform 50 and the prize platform 60 are of substantially equal weight and on opposing sides of a lever 40 that has a pivot 70 therebetween (FIG. 6). In such an embodiment, the critical weight that the plurality of accumulated coins 15 on the coin platform 50 must overcome is substantially the weight of the prize 18. In such an embodiment, the rotational axis $R_L$ of the pivot 70 of each lever 40 may be orthogonal to each longitudinal axes of the coin platform $L_c$ and prize platform $L_p$ of the lever 40, which are co-aligned. Each prize platform 60 in such an embodiment includes a deflector 110 for deflecting the prize 18 laterally into the prize chute 80 when the lever 40 tips.

Figure 3:
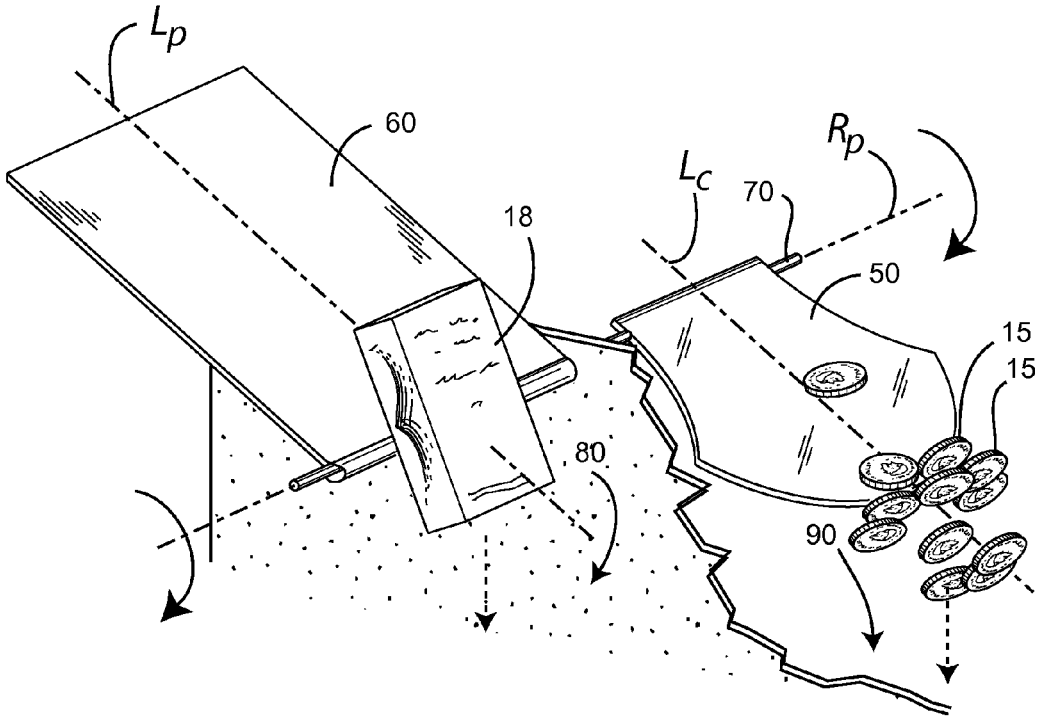
FIG. 3 is a perspective view of the platforms of FIG. 2 in a tipped configuration wherein coins on the coin platform have overcome the weight of the prize on the prize platform.

In an alternate embodiment of the invention, the longitudinal axes of the coin platform $L_c$ and prize platform $L_p$ of the lever 40 are parallel but laterally offset (FIGS. 2-4) such that when the lever 40 tips, the prize 18 slides towards the pivot 70 and then off the prize platform 60 and into the prize chute 80. The coins 15 on the opposing side of the lever 40, that is, on the coin platform 50, slide off of the coin platform 50 and into the profit chute 90. The longitudinal axes $L_c$, $L_p$ of the coin platform 50 and prize platform 60, respectively, illustrated in FIGS. 2, 3 and 6, may alternately describe the slide path of the coins 15 and prize 18, respectively, when the lever 40 tips. As such, the coin platform 50 and the prize platform 60 may be any suitable shape, such as round or clover leaf (not shown), or the like. Further, the lever 40 may be a parallelogram (not shown) wherein when the lever 40 tips, the slide paths are parallel and laterally offset so as to deliver the coins 15 and the prize 18 into different chutes 90,80, even if the longitudinal axes of the coin platform 50 and the prize platform 60 are coincident.

Figure 4:
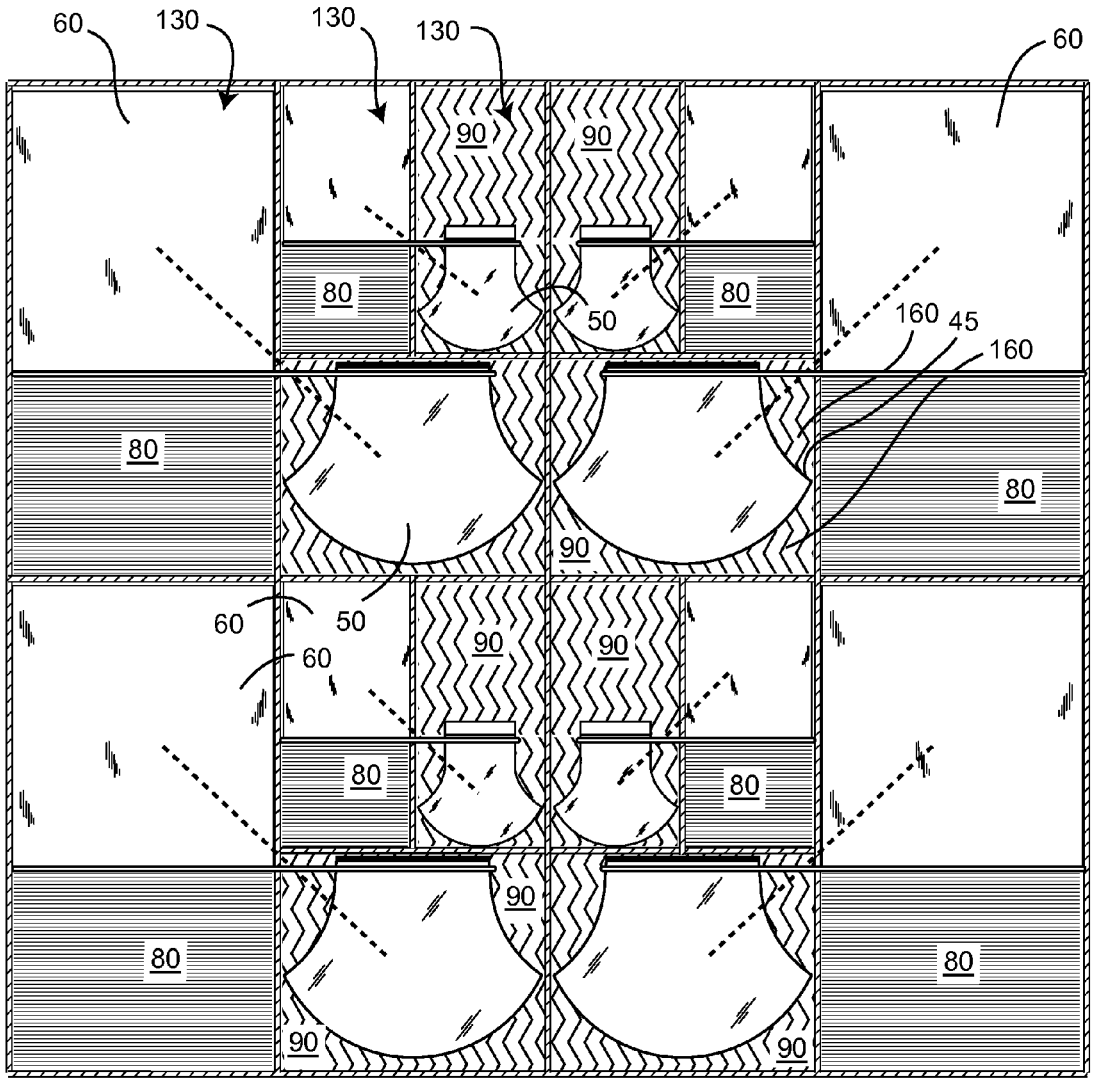
FIG. 4 is a plan view of compartments of a lever housing, coin and prize platforms, and coin and prize chutes of the invention, the coin and prize platforms that are mechanically interconnected being identified by the straight broken lines.

In one embodiment, the game 10 further includes a non-opaque playing field 20 having at least one aperture 25 therein (FIGS. 1, 2 and 4). The playing field 20 may include a raised end 28 positioned vertically higher than a lowered end 22 thereof, such that coins 15 introduced to the raised end 28 will slide down the playing field 20 towards the lowered end 22, some of the coins 15 perhaps dropping into the at least one aperture 25 if horizontally aligned with the at least one aperture 25 as the coin 15 slides down the playing field 20. The playing field 20 is preferably made from a durable, transparent Lexan, acrylic, or polycarbonate sheet material. The at least one apertures 25 may be a plurality of apertures 25 of varying sizes at least as wide as the diameter of the coins 15.

The coin delivery mechanism 30 is adapted to deliver the coins 15 to the playing field 20, sequentially as the player inserts each coin 15 therein. The coin delivery mechanism 30 may include a trajectory adjustment 140 such that the player may adjust the trajectory adjustment 140 before inserting one of the coins 15 therein so as to direct the coin 15 into a desired area of the playing field 20. Such a trajectory adjustment 140 may be a slide that adjusts the horizontal position of the coin delivery mechanism 30 (FIG. 1), for example. Further, a plurality of coin deflectors 150 may be included for imparting pseudo-random horizontal position adjustments to the coin 15 before the coin 15 is delivered to the playing field 20.

Figure 5:
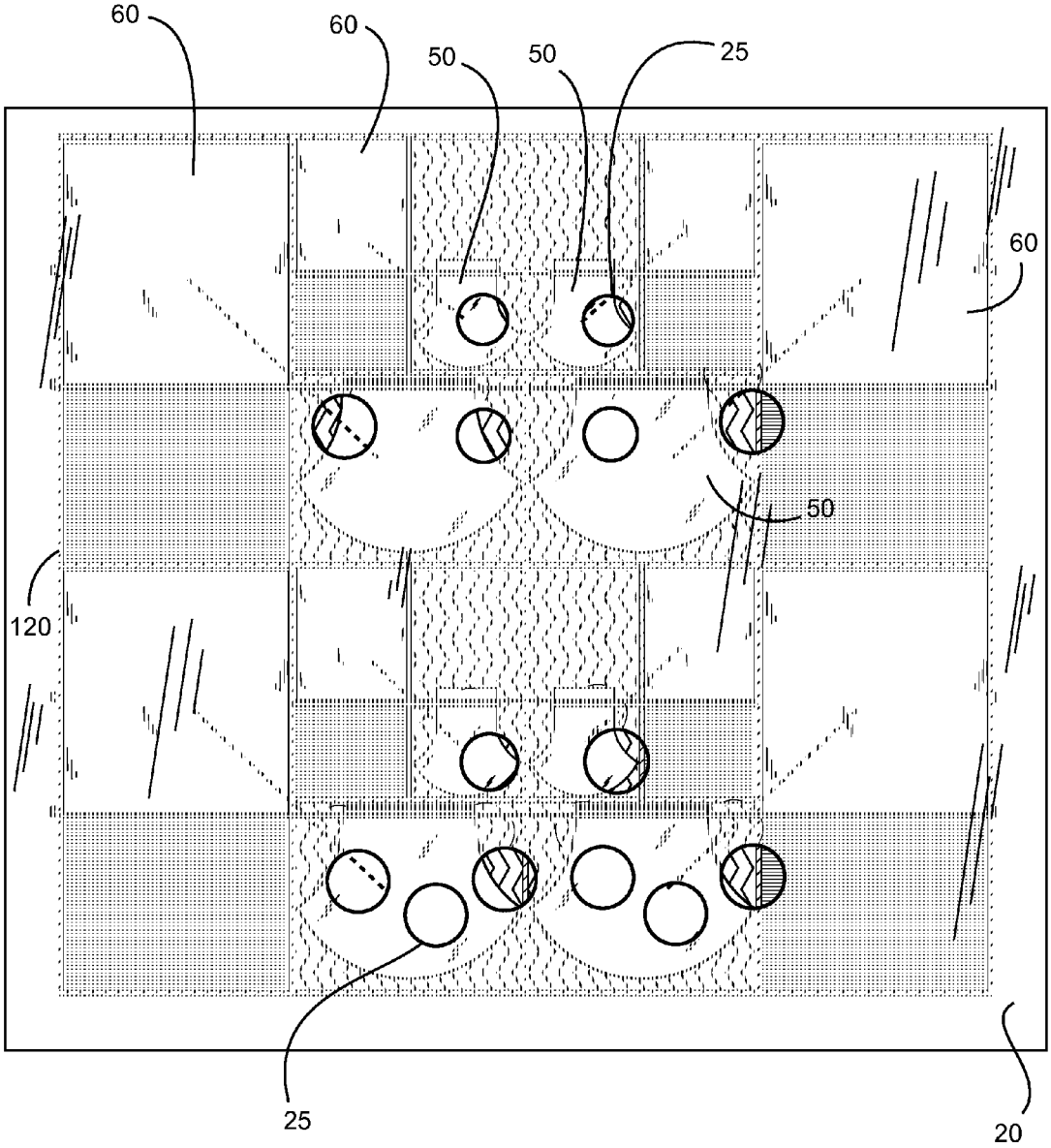
FIG. 5 is a plan view of the FIG. 4 overlaid with a playing field having apertures therethrough.

In one embodiment, the game 10 further includes a lever housing 120 (FIGS. 1, 4 and 5) with a plurality of compartments 130 for isolating a plurality of the prize platforms 60 from a plurality of the coin platforms 50. The pivots 70 of each lever 40 are fixed with the lever housing 120. In such an embodiment, a gap 160 is defined between each coin platform 50 and its associated compartment 130 (FIG. 4), such that coins 15 falling into the compartment 130 through one of the at least one apertures 25 may either be retained on the coin platform 50 or slip into the gap 160 between the coin platform 50 and the compartment 130 to fall into the profit chute 90. Such a coin platform 50 may include a non-linear side edge 45 (FIG. 4), the compartment 130 including linear walls, such that the gap 160 between the coin platform 50 and the compartment 130 is variable in width.

In use, with a prize 18 supported on each prize platform 60, the player uses the coin delivery mechanism 30 to deliver coins 15 to the playing field 20. Some of the coins 15 may fall through the at least one aperture 25 to collect on the coin platform 50 of the at least one lever 40, while the other coins 15 fall into the profit chute 90. When the weight of the coin platform 50 and the accumulated coins 15 thereon is sufficient to overcome the weight of the prize 18 and the prize platform 60, the lever 40 tips on the pivot 70 so that the prize 18 slides off of the prize platform 60 into the prize chute 80 for delivery to the player. The coins 15 on the tipping coin platform 50 fall into the profit chute 90.

A bottom side 62 of each prize platform 60 may include a weight attachment means 180 (FIG. 6), such that a weight 181 may be added to the weight attachment means 180 to increase the weight of the prize platform 60, which has the effect of increasing the critical weight, that is, number of coins 15 needed to counter the weight of the prize 18 and prize platform 60 to tip the lever 40.

A chassis 190 (FIG. 1) is preferably further included for housing the coin delivery mechanism 30, the playing field 20, the lever housing 120 and levers 40, prize chute 80, profit chute 90, and coin storage receptacle 100. The chassis 190 is open to the player at the coin delivery mechanism 30 and the prize chute 80. A lockable door 200 is further included for accessing the coin storage receptacle 100 and prize platforms 60, and further includes a window 210 to allow the player to see the playing field 20 and each lever 40 therethrough without being able to contact or otherwise interact with the playing field 20. A strong metal mesh screen 211 may be further included to prevent tampering with the balance of the levers 40 in the game 10.

Figure 7:
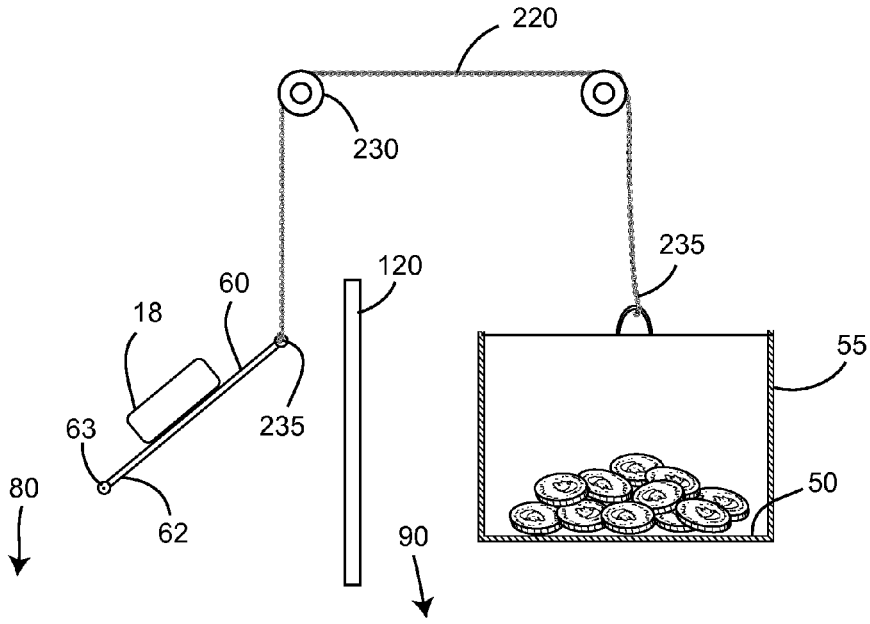
FIG. 7 is an elevational view of a second alternate embodiment of the invention, illustrating a mechanical linkage between the coin and prize platforms.
Figure 8:
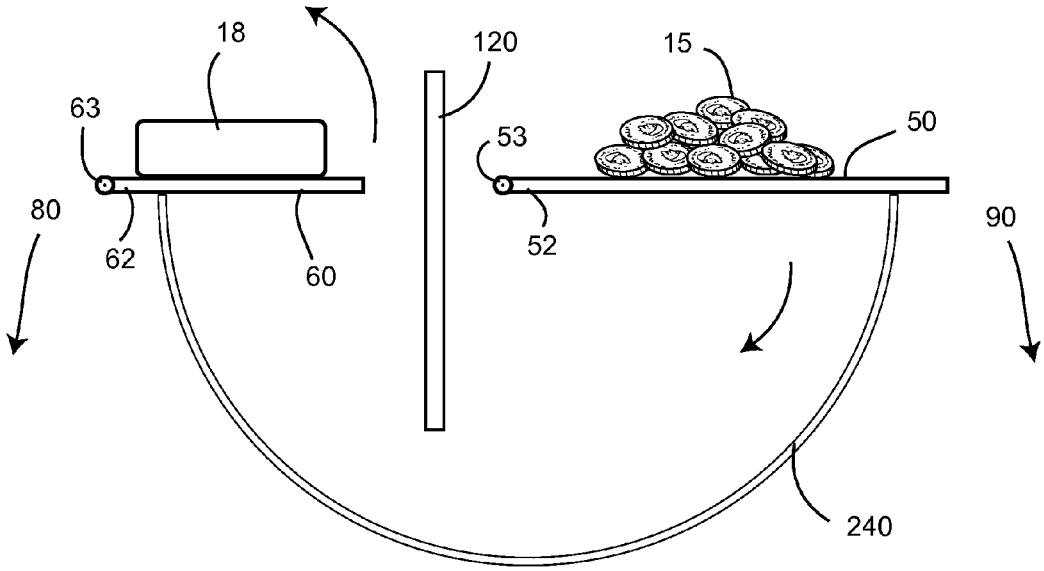
FIG. 8 is an elevation view of a third alternate embodiment of the invention showing a rigid arcuate mechanical linkage between the coin and prize platforms.
Figure 9:
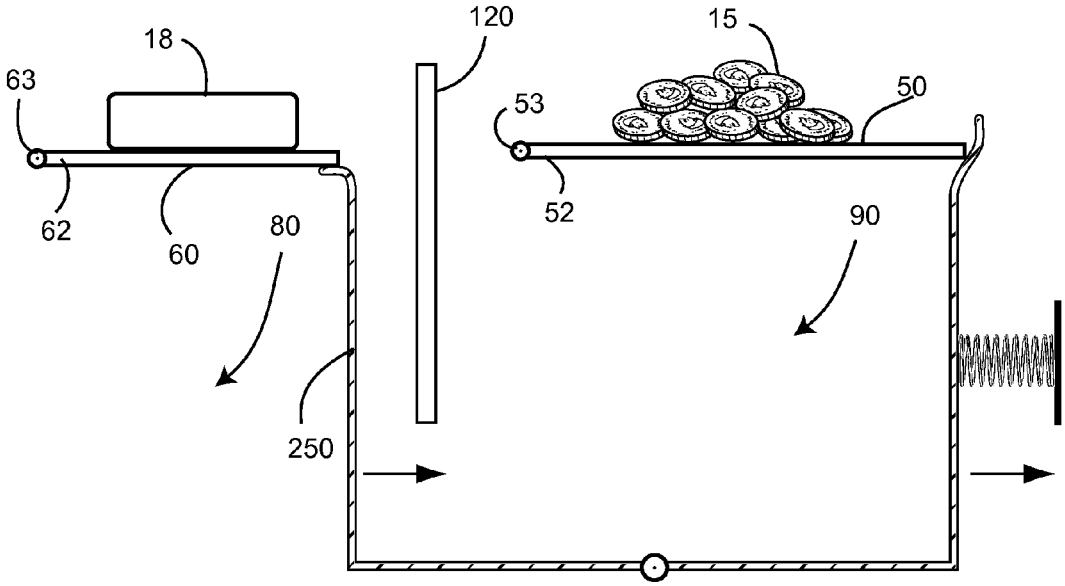
FIG. 9 is an elevation view of a forth alternate embodiment of the invention showing a trap door-type linkage between the coin and prize platforms.

While one preferred embodiment of the game 10 includes the levers 40, as illustrated in 2-6, alternate means of mechanically coupling each coin platform 50 to one other prize platform 60 are illustrated in FIGS. 7-9. With regard to FIG. 7, the prize platform 60 may include a pivot 63 at one side 62 thereof. The coin platform 50 may include a peripheral wall 55 for containing the plurality of the coins 15. As such, the coin platform 50 may alternately and accurately be described as a container. A mechanical linkage 220, such as a rope, chain, or cord, is looped around at least one pulley 230 and is fixed at either end 235 thereof to one of the platforms 50,60. When the weight of the coins 15 on the coin platform 50 reach the critical weight, the coin platform 50 pulls the mechanical linkage 220 around each pulley 230 to lift the prize platform 60 opposite the pivot 63, thereby titling the prize platform 60 to dispense the prize 18. In such an embodiment, a plurality of the prize platforms 60 and coin platforms 50 may be included within a housing (not shown, but similar to housing 120) having compartments 130 for isolating each of the prize platforms 60 and coin platforms 50, the pivots 63 of each prize platform 60 being fixed therewith, and the playing field 20 with a plurality of apertures generally aligned with the coin platforms 50 being further included. Such an embodiment may also be housed within the chassis 190 as explained above (FIG. 1).

With regard to FIG. 8, the prize platform 60 includes the pivot 63 at one side 62 thereof, and the coin platform 50 includes a pivot 53 at one side 52 thereof. The prize platform 60 is mechanically coupled with the coin platform 50 through an elongated rod 240 fixed with the prize platform 60. As such, when the coins 15 on the coin platform 50 reach the critical weight, the coin platform 50 tips at the pivot 53, causing the elongated rod 240 to push the prize platform 60 upward to tile at its pivot 63, such that the prize 18 slides off of the prize platform 60 and into the prize chute 80. In such an embodiment, a plurality of the prize platforms 60 and coin platforms 50 may be included within a housing (not shown, but similar to housing 120) having compartments 130 for isolating each of the prize platforms 60 and coin platforms 50, the pivots 53,63 of each platform 50,60 being fixed therewith, and the playing field 20 with a plurality of apertures generally aligned with the coin platforms 50 being further included. Such an embodiment may also be housed within the chassis 190 as explained above (FIG. 1).

With regard to FIG. 9, the prize platform 60 includes the pivot 63 at the one side 62 thereof, and further includes a stop mechanism 250 that prevents the prize platform 60 from pivoting downwardly to drop the prize 18 into the prize chute 80. The stop mechanism 250 is mechanically coupled to the coin platform 50 such that when the weight of the coins 15 on the coin platform 50 exceed the critical weight, the coin platform 50 retracts the stop mechanism 250 to allow the prize platform 60 to drop opposite the pivot 63, thereby allowing the prize 18 to slide off of the prize platform 60 and into the prize chute 80. Other such mechanical "trap-door" style stop mechanism 250 may be utilized to prevent the prize platform from dropping until the critical weight is achieved on the coin platform 50. In such an embodiment, a plurality of the prize platforms 60 and coin platforms 50 may be included within a housing (not shown, but similar to housing 120) having compartments 130 for isolating each of the prize platforms 60 and coin platforms 50, the pivot 63 of the prize platform 60 being fixed therewith, and the playing field 20 with a plurality of apertures generally aligned with the coin platforms 50 being further included. Such an embodiment may also be housed within the chassis 190 as explained about (FIG. 1).

While a particular form of the invention has been illustrated and described, it will be apparent that various modifications can be made without departing from the spirit and scope of the invention. For example, the specific shape of each coin platform 50 and prize platform 60 may be modified in any number of ways. Likewise, the specific coin delivery mechanism 30 described herein may be replaced with an alternate mechanism, such as those that deliver coins 15 by introducing the coins 15 to a rotating mechanism that flings the coins 15 into the chassis 190 above the coin platforms 50. The specific shape and style of the coin deflectors 150 illustrated herein may be replaced by any number of differently shaped coin deflectors 150, such as pachinko-style deflectors (not shown), or the like. Likewise, the specific number of coin platforms 50 and prize platforms 60, and the layout of the compartments 130 in the housing 120, may be rearranged from that shown in FIG. 4. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A game played with coins to deliver a prize to a player, comprising:

a coin platform adapted to receive and retain a plurality of the coins;

a coin delivery mechanism adapted to deliver the coins proximate the coin platform;

a prize platform adapted to support the prize and mechanically coupled with the coin platform to dispense the prize when the weight of the plurality of coins retained by the coin platform reaches a critical weight;

a prize chute situated below the prize platform and adapted to deliver the prize to the player when the prize falls from the prize platform; and a profit chute situated below the coin platform and adapted to deliver the coins falling into the profit chute into a coin storage receptacle;

whereby with a prize supported on the prize platform, the player uses the coin delivery mechanism to deliver coins proximate the coin platform, some of which are retained thereon, the others of which fall into the profit chute, such that when the weight of the accumulated coins on the coin platform reaches the critical weight, the prize platform dispenses the prize into the prize chute.

2. The game of claim 1 wherein the coin delivery mechanism further includes a non-opaque playing field have at least one aperture situated above the coin platform, whereby the player uses the coin delivery mechanism to deliver coins to the playing field, some of which fall through the at least one aperture to collect on the coin platform, the others of which fall into the profit chute.

3. The game of claim 2 wherein the coin platform and the prize platform are of substantially equal weight and on opposing sides of a lever having a pivot therebetween, whereby when the torque generated by the weight of the accumulated coins on the coin platform is sufficient to overcome the torque generated by the weight of the prize on the prize platform, the lever tips at the pivot so that the prize slides off of the prize platform into the prize chute, the coins on the coin platform falling into the profit chute.

4. The game of claim 3 wherein the rotational axis of the pivot of the lever is orthogonal to each longitudinal axis of the coin and prize platforms, the longitudinal axis of the coin and prize platforms being co-aligned, each prize platform including a deflector for deflecting the prize laterally into the prize chute when the lever tips.

5. The game of claim 3 wherein the rotational axis of the pivot is orthogonal to the longitudinal axis of the coin and prize platforms, the longitudinal axis of the coin and prize platforms of the lever being parallel but laterally offset such that when the lever tips the prize slides towards the pivot and then off of the prize platform into the prize chute, and the coins slide off the coin platform into the profit chute.

6. The game of claim 3 further including a plurality of the levers and a lever housing with compartments for isolating each of the prize platforms from the coin platforms, the pivots of each lever fixed therewith, the playing field including at least one of the apertures situated above each coin platform.

7. The game of claim 6 wherein each coin platform is substantially contained within one of the housing compartments, a gap between the coin platform and the compartment sufficient to receive one of the coins, such that coins falling into the compartment through one of the at least one apertures may either be retained on the coin platform or slip between the coin platform and the compartment to fall into the profit chute.

8. The game of claim 6 further including a chassis for housing the coin delivery mechanism, playing field, lever housing and levers, prize chute, profit chute, and coin storage receptacle, the chassis open to the player at the coin delivery mechanism and the prize chute, the chassis further including a lockable door for accessing the coin storage receptacle and prize platforms, and a window to allow the player to see the playing field and each lever therethrough.

9. The game of claim 6 wherein the plurality of levers include at least two levers of different sizes for accommodating prizes of different sizes and weights.

10. The game of claim 2 wherein the coin delivery mechanism includes a trajectory adjustment such that the player may adjust the trajectory adjustment before inserting a coin therein so as to direct the coin into a desired area of the playing field.

11. The game of claim 10 wherein the coin delivery mechanism further includes a plurality of coin deflectors for imparting pseudo-random position adjustments to the coin before the coin is delivered to the playing field.

12. The game of claim 2 wherein the playing field is sloped towards the profit chute, such that coins delivered to a raised end of the playing field will slide by gravity towards a lowered end of the playing field and then into the profit chute.

13. The game of claim 2 wherein the plurality of apertures in the playing field includes a plurality of apertures of varying sizes at least as wide as the diameter of the coins.

14. The game of claim 2 wherein the prize platform includes a pivot at one side thereof and the coin platform includes a peripheral wall for containing a plurality of the coins, a mechanical linkage looped around a pulley being fixed at either end to one of the platforms, such that when the weight of the coins on the coin platform exceed the weight of the prize and the prize platform, the coin platform pulls the mechanical linkage around the pulley to lift the prize platform opposite the pivot, thereby tilting the prize platform to dispense the prize.

15. The game of claim 14 further including a plurality of the prize platforms and coin platforms, and a housing with compartments for isolating each of the prize platforms from the coin platforms, the pivots of each prize platform fixed therewith, the playing field including at least one of the apertures situated above each coin platform.

16. The game of claim 15 further including a chassis for housing the coin delivery mechanism, playing field, housing and platforms, prize chute, profit chute, and coin storage receptacle, the chassis open to the player at the coin delivery mechanism and the prize chute, the chassis further including a lockable door for accessing the coin storage receptacle and prize platforms, and a window to allow the player to see the playing field and each lever therethrough.

17. The game of claim 2 wherein the prize platform includes a pivot at one side thereof, and further including an elongated rod fixed with the opposing side of the prize platform and itself pivotally fixed with the coin platform, such that when the weight of the coins on the coin platform exceed the critical weight, the coin platform pivots the elongated rod to lift the prize platform opposite the pivot, thereby tilting the prize platform to dispense the prize.

18. The game of claim 17 further including a plurality of the prize platforms and coin platforms, and a housing with compartments for isolating each of the prize platforms from the coin platforms, the pivots of each prize platform fixed therewith, the playing field including at least one of the apertures situated above each coin platform.

19. The game of claim 18 further including a chassis for housing the coin delivery mechanism, playing field, housing and platforms, prize chute, profit chute, and coin storage receptacle, the chassis open to the player at the coin delivery mechanism and the prize chute, the chassis further including a lockable door for accessing the coin storage receptacle and prize platforms, and a window to allow the player to see the playing field and each lever therethrough.

20. The game of claim 2 wherein the prize platform includes a pivot at one side thereof and a stop mechanism for preventing the prize platform from pivoting downwardly to drop the prize into the prize chute, the stop mechanism mechanically coupled to the coin platform such that when the weight of the coins on the coin platform exceed the critical weight, the coin platform retracts the stop mechanism to drop the prize platform opposite the pivot, thereby tilting the prize platform to dispense the prize.

21. The game of claim 20 further including a plurality of the prize platforms and coin platforms, and a housing with compartments for isolating each of the prize platforms from the coin platforms, the pivots of each prize platform fixed therewith, the playing field including at least one of the apertures situated above each coin platform.

22. The game of claim 21 further including a chassis for housing the coin delivery mechanism, playing field, housing and platforms, prize chute, profit chute, and coin storage receptacle, the chassis open to the player at the coin delivery mechanism and the prize chute, the chassis further including a lockable door for accessing the coin storage receptacle and prize platforms, and a window to allow the player to see the playing field and each lever therethrough.

23. The game of claim 1 wherein the prize platform includes a stop for preventing the prize platform from dropping below a horizontal position.

24. The game of claim 23 wherein a bottom side of the prize platform includes a weight support, such that weights may be added to the weight support to increase the weight of the prize platform, thereby increasing the number of coins needed to counter the weight of the prize platform and tip the lever.

* * * * *